US006038986A

United States Patent [19]

Ransil et al.

[11] Patent Number: 6,038,986

[45] Date of Patent: Mar. 21, 2000

[54] BRAKE OPERATIONAL CONTROL

[75] Inventors: Matthew J. Ransil, Ashville; Donald R. Pangborn, Jamestown, both of N.Y.

[73] Assignee: Weber Knapp Company, Jamestown, N.Y.

[21] Appl. No.: 09/215,838

[22] Filed: Dec. 17, 1998

[51] Int. Cl.[7] ..... A47B 9/00

[52] U.S. Cl. ..... 108/145; 108/146; 108/147; 248/421; 248/585

[58] Field of Search ..... 108/147, 144.11, 108/145, 146; 248/157, 421, 631, 585, 292.13

[56] References Cited

U.S. PATENT DOCUMENTS

| | | | |
|---|---|---|---|
| 2,982,050 | 5/1961 | May | 108/145 X |
| 3,213,809 | 10/1965 | Kritske | 108/146 |
| 3,710,735 | 1/1973 | Litvinoff et al. | 108/2 X |
| 4,360,180 | 11/1982 | Bruneau | 108/146 X |
| 4,577,730 | 3/1986 | Porter . | |
| 4,898,103 | 2/1990 | Pontoppidan et al. | 108/145 |
| 5,704,299 | 1/1998 | Corpuz, Jr. et al. . | |
| 5,706,739 | 1/1998 | Shaheen et al. . | |
| 5,797,331 | 8/1998 | Watt . | |

*Primary Examiner*—Janet M. Wilkens
*Attorney, Agent, or Firm*—Simpson, Simpson & Snyder, LLP

[57] ABSTRACT

A height adjustable mechanism for supporting a work support for vertical movement relative to a base includes a counterbalance mechanism for providing a force opposing a downward force tending to lower the work support; a lock mechanism for releasably retaining the work support in a desired vertical position; and a manual operator for selectively releasing the lock mechanism to permit vertical movement of the work surface, while preventing operation of the lock mechanism if the counterbalance force and the downward force are out of balance by some given extent. In the preferred construction, the lock mechanism is pivotally supported by a pin normally supported for axial sliding movement under the control of the manual operator, and the lock mechanism applies loading to the pin, when the counterbalance force substantially differs from the downward force, sufficient to constrain the pin against sliding movement, and thereby prevent release of the lock mechanism by the manual operator.

10 Claims, 4 Drawing Sheets

FIG. 4
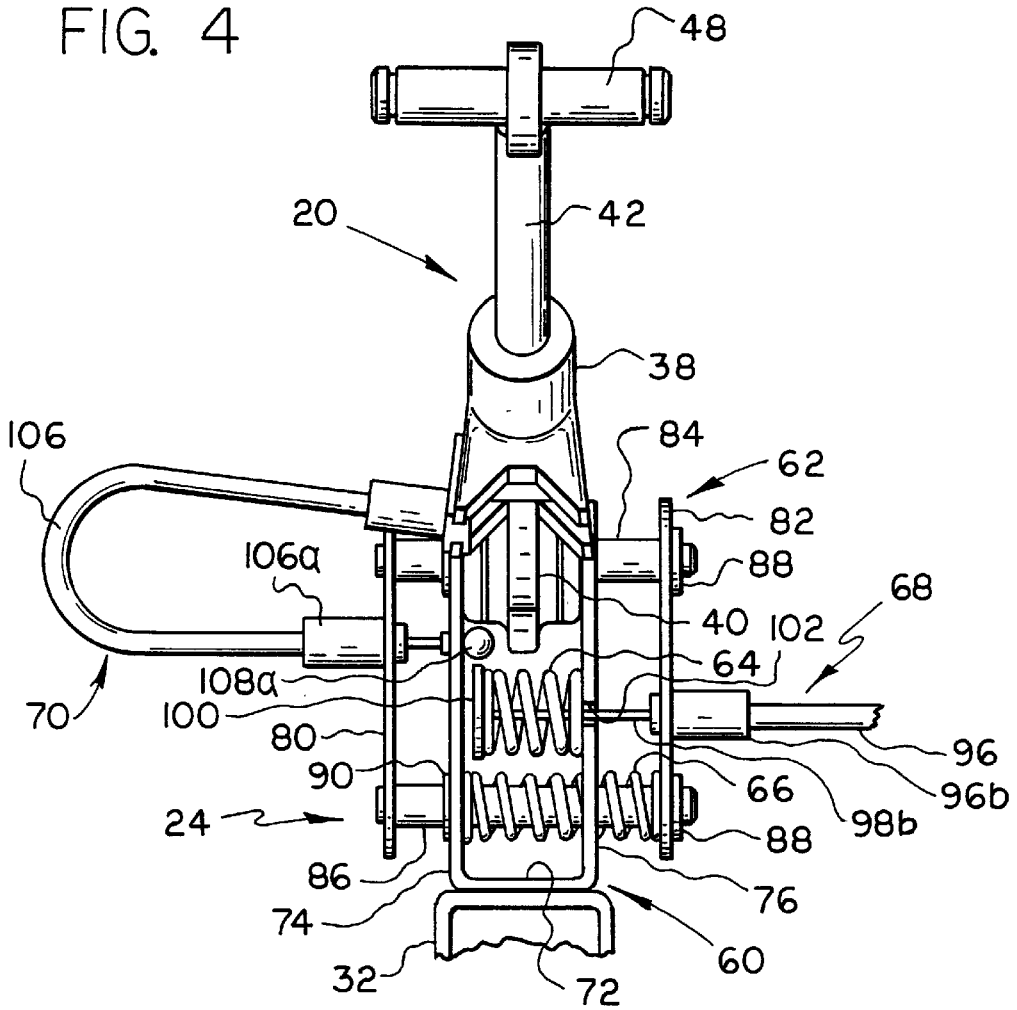
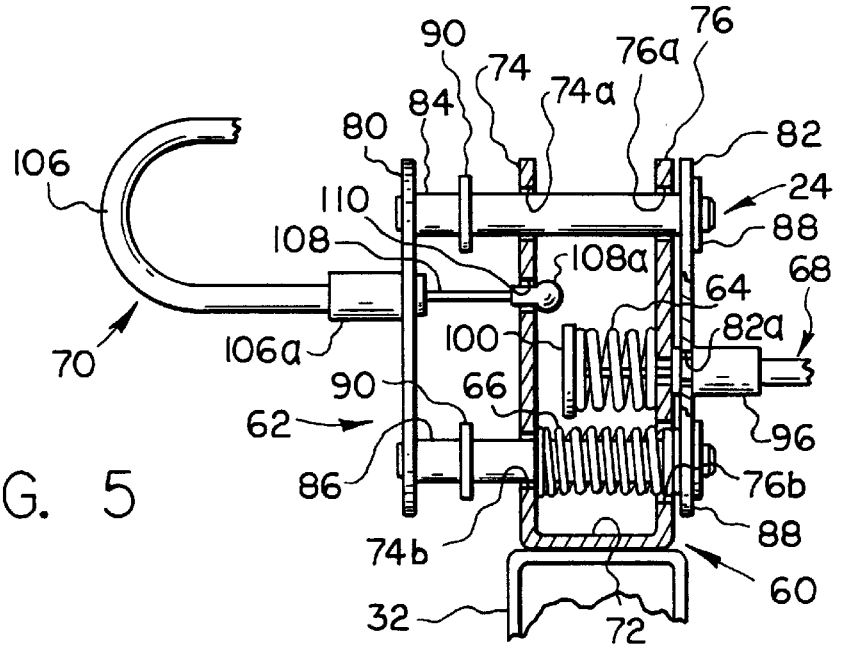
FIG. 5

BRAKE OPERATIONAL CONTROL

BACKGROUND OF THE INVENTION

It is known to provide a height adjustment mechanism for a telescopic leg supported work surface including a counterbalance mechanism for providing a counterbalance force opposing a downward force tending to lower the work surface, a lock mechanism for releasably retaining the work surface in a desired vertical position, and a manual operator for selectively releasing the lock mechanism to permit vertical movement of the table top, while preventing operation of the lock mechanism if the counterbalance force and the downward force are out of balance, as evidenced by U.S. Pat. No. 5,706,739.

It is also known to employ a mechanical lock of the type disclosed in U.S. Pat. No. 4,577,730 to releasably lock a 20 work surface against vertical movement, as evidenced by U.S. Pat. No. 5,704,299.

SUMMARY OF THE INVENTION

The present invention is directed towards a height adjustment mechanism for a work surface and more particularly to an improved mechanism employing a lock mechanism for releasably retaining the work surface in a desired vertical position, and an operator for selectively releasing the lock mechanism except when vertically downwardly directed forces acting on the work surface differ substantially or by some given amount from a counterbalance force tending to oppose downward movement of the work surface.

BRIEF DESCRIPTION OF THE DRAWINGS

The nature and mode of operation of the present invention will now be more fully described in the following detailed description taken with the accompanying drawings wherein:

FIG. 4 is an elevational view of the lock mechanism and coupling means with the operating paddle in released condition and the work surface in locked condition;

FIG. 5 is a fragmentary view similar to FIG. 4, but showing the operating paddle engaged condition and the work surface in a balanced and unlocked condition;

DETAILED DESCRIPTION

Figure 1:
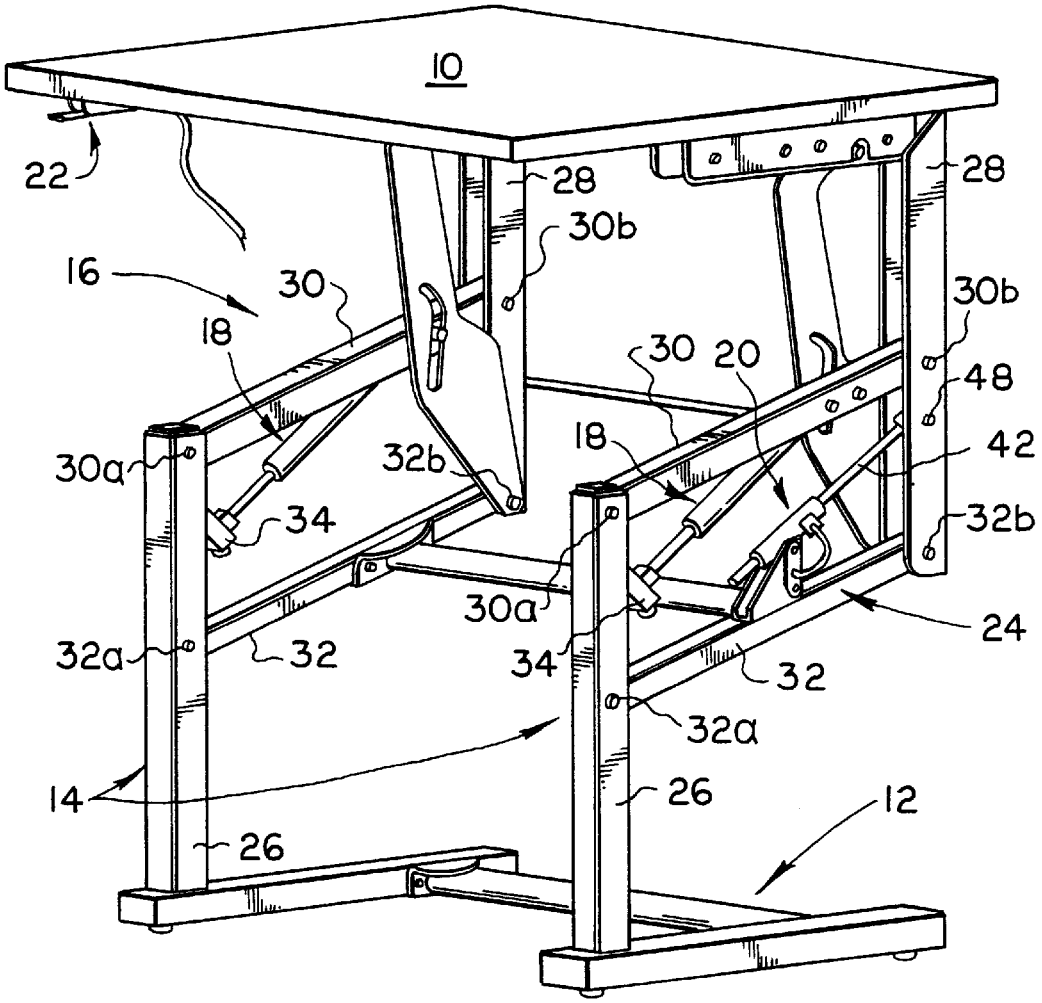
FIG. 1 is a prospective view of a work station having a vertically movable work surface.

In FIG. 1 there is generally shown a work station having a work surface 10 supported for vertical movement relative to a base 12 by mounting means including a parallelogram linkage mechanism 14. A counterbalance mechanism including a pair of conventional gas charged pressure cylinders or springs 18 and 18 is adapted to provide a counterbalance force opposing a downward force tending to lower the work surface 10. A lock mechanism 20 is employed to releasably retain work surface 10 in a desired vertical position, and a control means including an operator 22 carried beneath work surface 10 and coupling means 24 adapted to couple the operator to lock mechanism 20 for selectively releasing lock mechanism 20 to permit vertical movement of the work surface.

Parallelogram linkage mechanism 14 includes a pair of first elements 26 fixed to upstand relative to base 12, a pair of second elements 28 fixed for vertical movement with work surface 10, and pairs of connecting link elements 30 and 32, which have their opposite ends pivotally coupled to elements 26 and 28 by pivot pins 30*a*, 32*a* and 30*b*, 32*b*, respectively.

Preferably, counterbalance mechanism 16 includes an adjustment device 34 adapted to vary the moment arm through which springs 18 and 18 act on linkage mechanism 14, and thus the counterbalance force available for opposing the downward force resulting from the weight of work surface 10 and the weight of any object applied thereto.

Lock mechanism 20 is preferably of the general type described in U.S. Pat. No. 4,577,730, wherein a housing 38 is formed with a mounting lug 40 having a through mounting opening 40*a*, shown only in FIG. 2, and serves to mount a rod 42 for sliding movement lengthwise thereof. Housing 38 encloses one or more coil springs, not shown, which are arranged concentrically of and tend to frictionally grip rod 42 in order to normally prevent sliding movement thereof relative to the housing. Lock release means including an operating lug 44 arranged to radially protrude from housing 38 is connected to the coil spring(s). Lug 44 has normal locking and release positions shown in full and broken line in FIG. 3, and upon movement into its release position by a release force established by operator 22 serves to uncoil the spring(s) relative to rod 42 sufficiently to free the rod for sliding movement. One protruding or free end of rod 42 is formed with a connecting opening 46 sized to receive a pivot pin 48 by which the rod is connected to second element 28 for pivotal movement about a pivot axis disposed parallel to the axes of pivot pins 30*a*, 32*a*, 30*b* and 32*b*.

Figure 2:
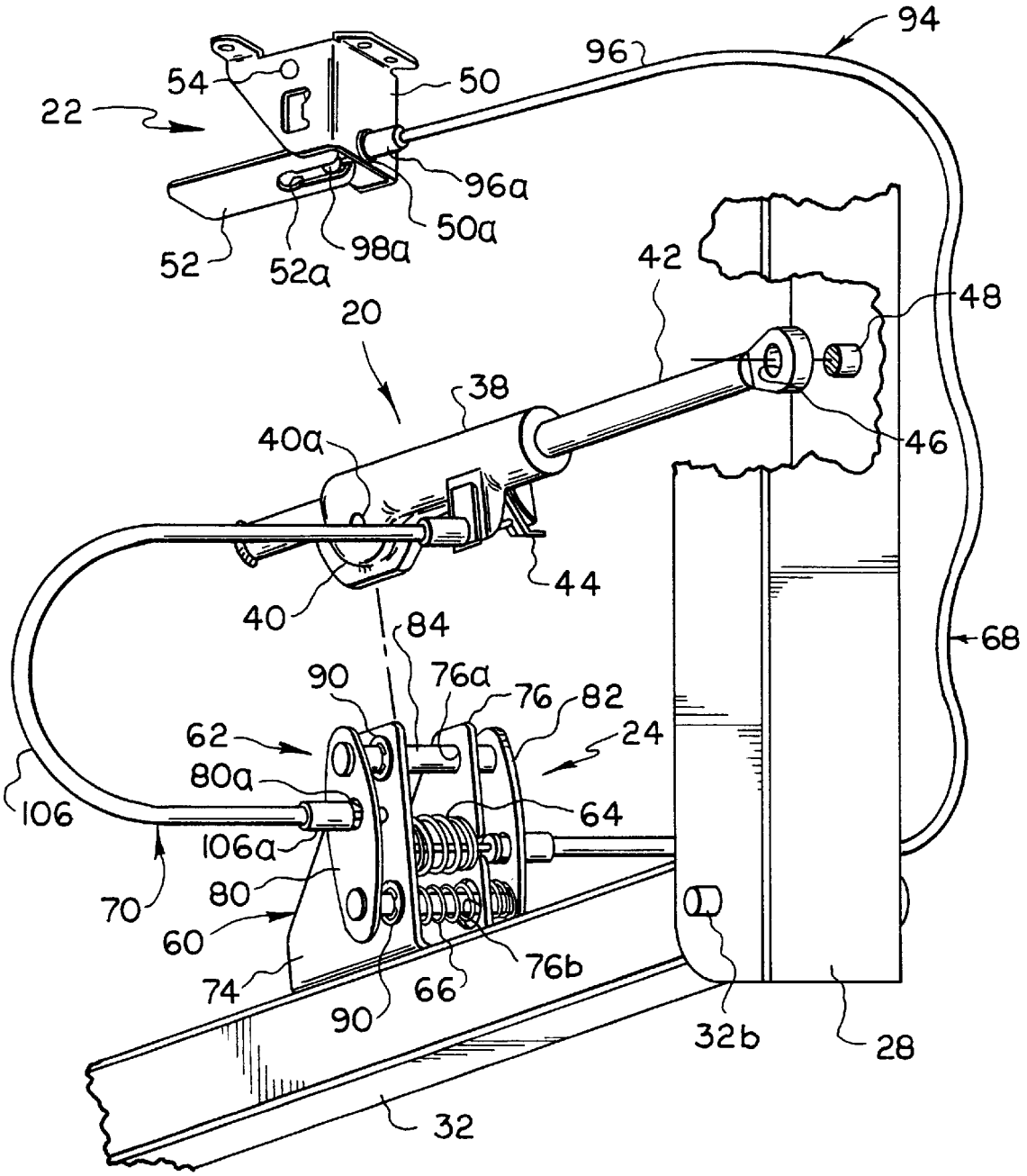
FIG. 2 is an enlarged prospective view of a mechanism adapted for releasably retaining the work surface in a desired vertical position and a manually operable control therefore.

Operator 22 is best shown in FIG. 2 as including a mounting bracket 50, which is preferably mounted for movement with work surface 10, and a manually manipulated paddle 52 pivotally supported on the bracket by a pivot pin 54.

A preferred form of coupling means 24 is best shown in FIGS. 2 and 4–6 as generally including a generally U-shaped mounting member 60 suitably fixed to one of connecting link elements 32; a slide member 62; first and second coil springs 64 and 66; an input coupling device 68; and an output coupling device 70.

Figure 6:
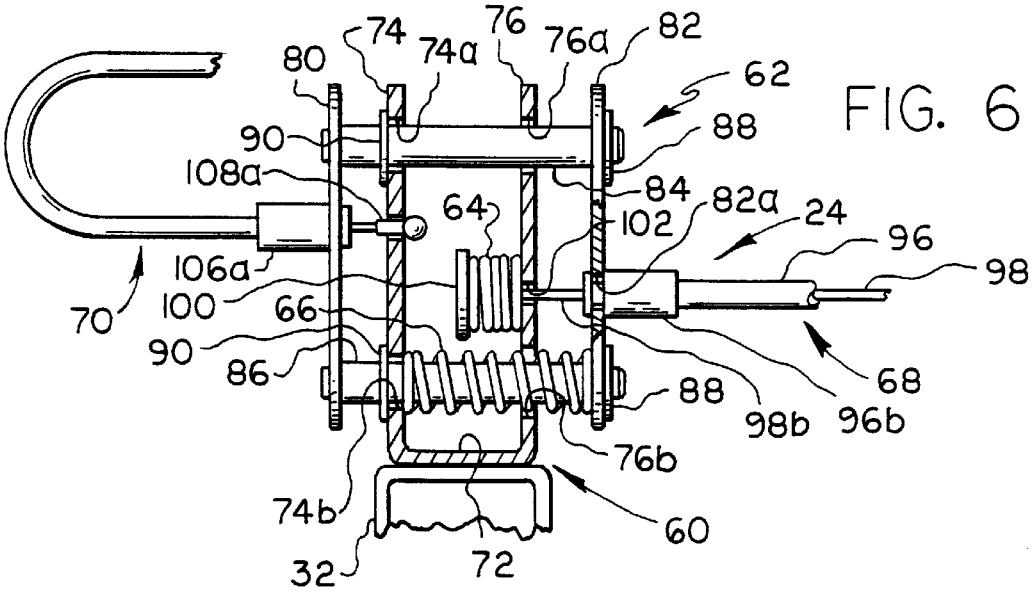
FIG. 6 is a view similar to FIG. 5, but showing the operating paddle engaged and the work surface in a locked and unbalanced condition.

Mounting member 60 includes a base flange 72 fixed to connecting link element 32 and upstanding and parallel first and second sides or side flanges 74 and 76 formed with aligned pairs of through bore openings 74*a*, 76*a* and 74*b* and 76*b*, as best shown in FIG. 5 and 6.

Slide member 62 is best shown in FIGS. 2 and 4–6 as including parallel first and second plates 80 and 82, which are interconnected by a pair of parallel first and second mounting pins 84 and 86 arranged to movably extend through openings 74*a*, 76*a* and 74*b*, 76*b*, respectively, for purposes of supporting the slide member for sliding or reciprocating movement relative to mounting member 60. In the illustrated construction, first plate 80 is suitably, permanently fixed to first ends of mounting pins 84 and 86 and second plate 82 is removably fixed to reduced diameter second or opposite end of such mounting pins by C-shaped snap rings 88 in order to facilitate assembly of the slide member. Further C-shaped snap rings 90 are fitted within annular recesses, not shown, formed in mounting pins 84 and 86 adjacent their first ends and arranged to engage with first side 74 of mounting member 60 for limiting sliding movement of slide member 62 relative to the mounting member to the right, as viewed in FIGS. 4 and 6.

Input coupling device 68 is shown in FIGS. 2 and 4–6 as being in the form of a first flexible cable 94 having a first outer sheath 96 and a first inner wire 98 slidably received within sheath 96 for sliding movement lengthwise thereof. A first or input mounting end 96*a* of first sheath 96 is fixed to mounting bracket 50 via a key-shaped slot 50*a*, and a first or input end 98*a* of first wire 98 is fixed to paddle 52 via a key-shaped 52*a*. A second or output mounting end 96*b* of first sheath 96 is fixed to second plate 82 via a key-shaped slot 82*a*, and a second or output end 98*b* of first wire 98 is rigidly fixed to an abutment plate 100, as by welding. As best shown in FIGS. 2 and 4–6, wire output end 98*b* freely extends through second plate 82 and a slot 102, which opens transversely through a side edge of second side flange 76. First spring 64 is disposed generally concentrically of the wire output end 98*b* in end abutting engagement with abutment plate 100 and second side flange 76.

Output coupling device 70 is also shown in FIGS. 2 an 4–6 as being in the form of a second flexible cable having a second sheath 106 and a second inner wire 108 slidably received within sheath 106 for sliding movement lengthwise thereof. A first or input end 106*a* of second sheath 106 is fixed to first plate 80 via a key-shaped slot 80*a* shown only in FIG. 2, and a first or input end 108*a* of second wire 108 is fixed to first side flange 74 via a key-shaped slot 110. A second or output end 106*b* of second sheath 106 is shown in FIG. 3 as being suitably fixed to a flange 112 formed integrally with housing 38 of lock mechanism 20, and a second or output end 108*b* of second wire 108 is fixed to lug 44 via a key-shaped slot, not shown.

Coupling means 24 is completed by arranging second spring 66 concentrically of second mounting pin 86 to extend freely through opening 76*b* of second side flange 76 for opposite end abutting engagement with facing surfaces of first side flange 74 and second plate 82; and by arranging mounting lug 40 intermediate first and second side flanges 74 and 76 with mounting pin 84 slidably extending through mounting opening 40*a*, whereby to operably connect lock mechanism to coupling means 24.

In the above construction, the opposite ends of first cable sheath 96 are considered to be fixed against movement relative to operator 22 and slide member 62, and the opposite ends of the second cable sheath 106 are considered to be fixed against movement relative to slide member 62 and lock mechanism 20, whereby to effect sliding movement of first and second wires 98 and 108 relative to their associated sheaths.

Figure 3:
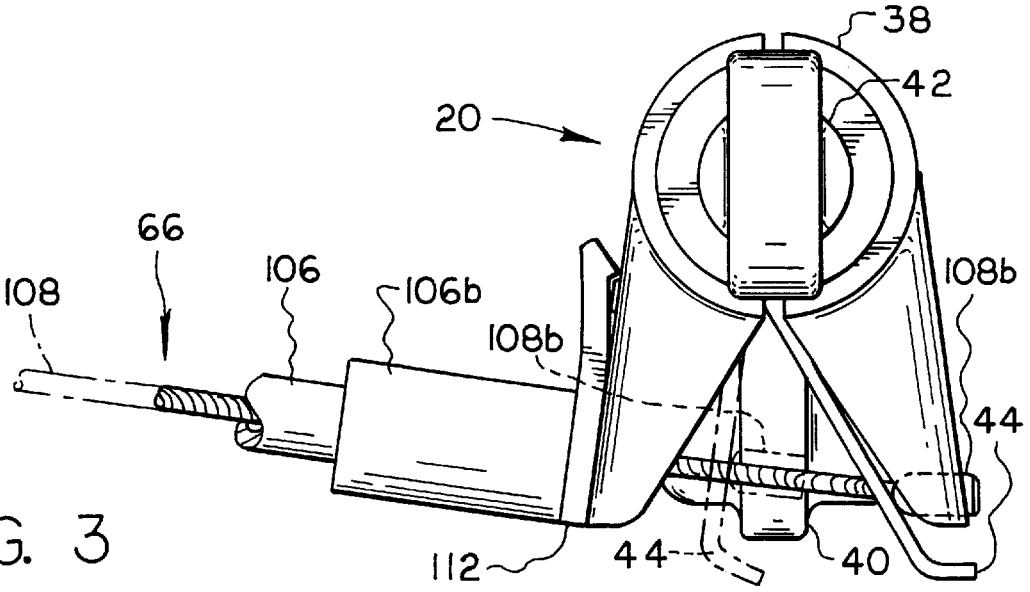
FIG. 3 is an end view of the lock mechanism.

In operation, when paddle 52 is released, coupling means 24 is disposed in a rest or locked position shown in FIG. 4, wherein lock mechanism 20 is permitted to rest in its locked position shown is full line in FIG. 3, whereby serving to lock work surface 10 in a vertical position into which it had previously been moved. More specifically, when manual pressure is removed from paddle 52, first spring 64 resiliently extends until abutment plate 100 engages with or lies closely adjacent first side flange 74, whereby first wire 98 slides lengthwise within sheath 96 in a manner tending to shorten first wire end 98*a* and lengthen second wire end 98*b* relative to the sheath. Second spring 66 serves to maintain slide member 62 in its rest position determined by engagement of snap rings 90 with first side flange 74.

When an operator desires to change the vertical position of work surface 10, he manually pivots paddle 52 relative to mounting bracket 50 about pivot 54 against the bias of first spring 64 for purposes of sliding first wire 98 within first sheath 96 in a manner tending to lengthen the projecting portion of first wire end 98*a* and shorten the projecting portion of second wire end 98*b*, and assuming slide member 62 is free to slide, moving the slide member through the position shown in FIG. 5 into a lock mechanism release position defined by abutting engagement of second plate 82 with second side flange 76. Incident to this sliding movement of slide member 62, second wire 108 is caused to slide within sheath 106 to extend the projecting end of first wire end 108*a* and shorten the projecting end of second wire end 108*b*. Shortening of second wire end 108*b* serves to swing operating leg 44 into its unlocking position shown in broken line in FIG. 3, whereby freeing rod 42 for sliding movement relative to housing 38, and thus free work surface 10 for vertical movement relative to base 12.

In accordance with the present invention, normal release of work surface 10 upon manually induced pivotal movement of paddle 52, as described above, is prevented whenever vertically downwardly directed forces acting on the work surface differ substantially or by some given extent from the counterbalance force developed by springs 18 and 18, which tend to oppose downward movement of the work surface. When this unbalanced situation exists, rod 40 is subject to an increased axial compressive loading, which tends to displace housing 38 transversely of the axis of first mounting pin 84 with the result that the frictional forces acting between the mounting pin and the inner surface of mounting opening 40*a* increase to a point at which sliding movement of slide member 62 away from its rest position of FIG. 4 is arrested, as indicated in FIG. 6. The presence of first spring 64 allows for operation of paddle 52 without damage to coupling means 24.

Upon subsequent return of the forces acting on work surface 10 to a substantially balanced condition, the frictional braking forces acting between mounting pin 84 and mounting lug 40 are reduced to a point at which relative sliding movements of slide member 62 and mounting member 60 may occur whenever paddle 52 is operated for purposes of releasing lock mechanism 20.

Figure 7:
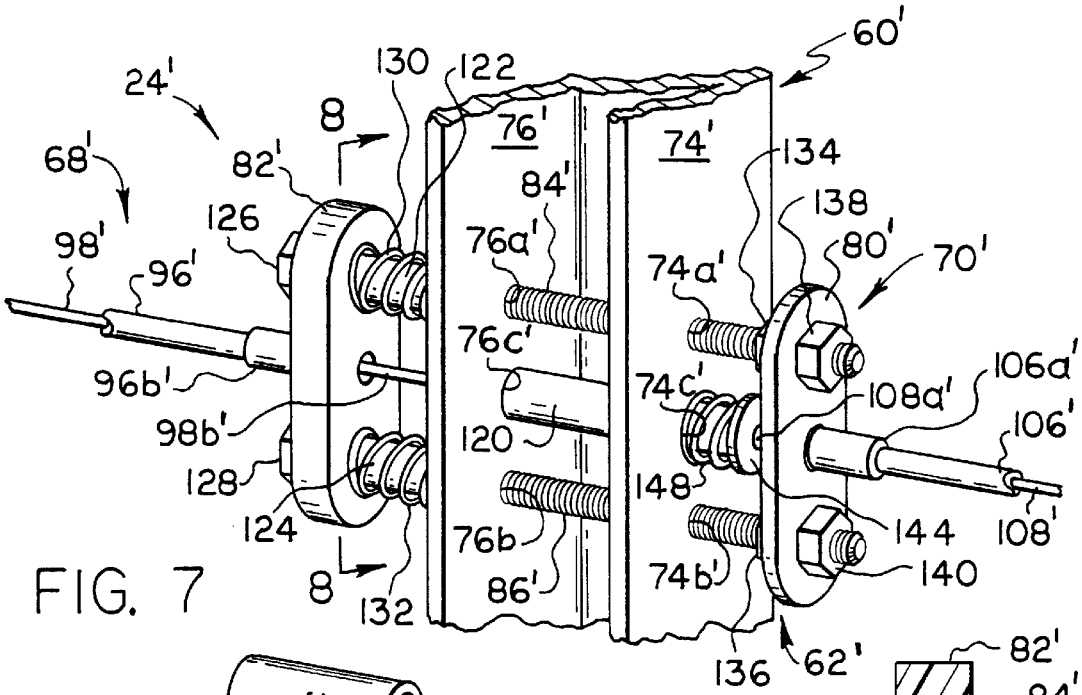
FIG. 7 is a prospective view of an alternative form of the invention.
Figure 8:
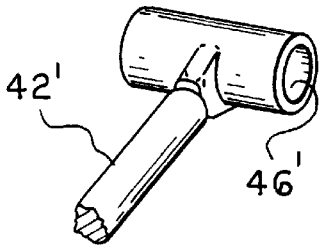
FIG. 8 is a sectional view taken generally along the line 8—8 in FIG. 7.
Figure 8:
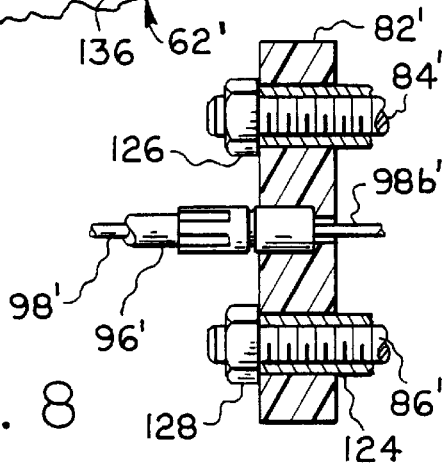

An alternative form of the invention is shown in FIGS. 7 and 8 where a member 62' is mounted on a U-shaped mounting member 60' formed for example by one of the elements of the above-described linkage mechanism, such as second element 28', and rod 42' of the lock mechanism is pivotally coupled to a third or connector pin 120 slidably fitted within rod connecting opening 46'. Mounting member 60' includes first and second side flanges 74' and 76' formed with aligned pairs of threaded openings 74*a*', 76*a*' and 74*b*', 76*b*', and an additional pair of aligned bore openings 74*c*', 76*c*' for slidably receiving third pin 120. Member 62' includes parallel first and second plates 80' and 82', which are interconnected by a pair of parallel first and second screw threaded mounting rods 84' and 86' arranged to be threadably received by openings 74*a*', 76*a*' and 74*b*', 76*b*', respectively.

Spacer sleeves 122 and 124 are disposed concentrically of rods 84' and 86' intermediate second side flange 76' and first nuts 126 and 128, which are threaded onto first ends of screws 84' and 86', and serve to slidably support the first plate 82' for sliding movement axially of the spacer sleeves against the bias of coil springs 130 and 132 disposed concentrically of such spacer sleeves. Second ends of rods 84' and 86' are provided with second nuts 134 and 136 and third nuts 138 and 140 for clamping first plate 80' in position adjacent such second ends.

Input coupling device 68' includes a first flexible cable having a first outer sheath 96' and a first inner wire 98' slidably received within sheath 96'. A first end of sheath 96' is non-movably connected to a paddle mounting bracket, not shown, and a second end 96*b*' is suitably fixed to second plate 82'. A first end of first wire 98' is fixed to a manually operable paddle, not shown, and a second end 98*b*' is suitably fixed to a first end of third pin 120.

Output coupling device 70' includes a second flexible cable having a second outer sheath 106' and a second inner wire 108' slidably received within sheath 106'. A first end 106*a*' of sheath 106' is suitably fixed to first plate 80' and a second end thereof is non-movably fixed to the above-mentioned flange of lock mechanism housing, not shown. A first end 108*a*' of second wire 108' freely passes through second plate 80' and is fixed to an abutment disc 144 and a second end of third pin 120, and a second end of the second wire is fixed to the above-mentioned lug of the lock mechanism, not shown.

Coupling means 24' is completed by arranging a compression spring 148 concentrically of third pin 120 intermediate abutment disc 144 and first side flange 74'. The mechanism is completed by pivotally coupling the above housing of lock mechanism to one of the connecting link elements, not shown, which is coupled to second element 60'.

The alternative form of the invention has a rest position shown in FIG. 7, wherein springs 130 and 132 maintain second plate 82' in abutting engagement with nuts 126 and 128, and spring 148 tensions first wire 98' to normally maintain same extended to the right relative to sheath 96', as viewed in FIG. 7. In that wire 98' is connected to wire 108' via a third pin 120, wire 108' is caused to be displaced to the right relative to sheath 106', as viewed in FIG. 7, such that the lug of the lock mechanism is retained in its locked position shown in full line in FIG. 3. As will be apparent, wire 98', third pin 120 and wire 108' form a continuous connection or coupling extending between the operating paddle and the lug of the lock mechanism.

When a user depresses the paddle connected to wire 98', such wire is moved to the left, as viewed in FIG. 7, whereby third pin 120 is moved to the left relative to mounting member 60' against the bias of spring 148 and second wire is displaced relative to sheath 108' sufficiently to pivot the lug of the lock mechanism into its unlocked position viewed in broken line in FIG. 3 to release rod 42' for movement. During movement of wire 98', sheath 96' tends to push plate 82' to move towards side flange 76' against the bias of springs 130 and 132.

Whenever vertical direct forces acting on the work surface differ substantially or by some given or pre-set amount from the counterbalance force developed by the above-mentioned springs, rod 42' is subject to increased axial loading, which tends to displace the lock mechanism housing transversely of the axis of third pin 120 with the result that frictional forces acting between the third pin and the inner surface of rod mounting opening 46' increases to a point at which sliding movement of the third pin away from its rest position of FIG. 7 is arrested. The presence of springs 130 and 132 allow movement of plate 82' into a position disposed closely adjacent side flange 76' thereby to allow operation of the paddle without damage to the coupling means.

As will be apparent, the positioning of the rod and its associated housing of the lock mechanism, shown in FIGS. 2 and 7, may be reversed from that shown.

What is claimed is:

1. A mechanism having a base; a work surface; mounting means for mounting said work surface for vertical movement relative to said base; a counterbalance mechanism for providing a counterbalance force opposing a downward force tending to lower said work surface; a locking mechanism for releasably retaining said work surface in a desired vertical position, said locking mechanism including release means for releasing said locking mechanism to permit vertical movement of said work surface; and control means for selectively controlling said release means, said control means having an operator movable between locking and release positions and coupling means to couple said operator to said release means for normally effecting operation of said release means upon movement of said operator into said release position, and said locking mechanism is connected to said coupling means intermediate said operator and release means for preventing operation of said release means by said operator when said counterbalance and downward forces are out of balance by some given extent.

2. A mechanism according to claim 1, wherein said locking mechanism additionally includes a housing and a rod slidably supported by said housing, one of said rod and said housing is frictionally connected to said coupling means and the other of said rod and said housing is connected to said mounting means.

3. A mechanism according to claim 2, wherein said coupling means includes:

a mounting member;

a slide member having first and second plates;

pin means for slidably supporting said slide member on said mounting member for sliding movement;

first and second cables having first and second outer sheaths slidably supporting first and second wires for movement lengthwise thereof, said sheaths having adjacent ends and opposite ends with said adjacent ends being fixed to said second and first plates respectively, and having said opposite ends fixed against movement relative to said operator and housing, respectively, said first wire having a first end movable in response to operation said operator and a second end freely extending through said second plate, said second wire having a first end freely extending through said first plate and being fixed to said mounting member and having a second end connected to said release means;

spring means resiliently opposing said sliding movement of said slide member in a first direction; and a further spring means for resiliently opposing movement of said second end of said first wire in a direction opposite to said first direction, and said one of said housing and said rod is frictionally slidably connected to said pin means for preventing sliding movement of said slide member in said first direction when said counterbalance force and said downward force are out of balance by some given extent.

4. A mechanism according to claim 3, wherein one of said housing is pivotally connected to said pin means and said rod is pivotally coupled to said mounting means for said work surface.

5. A mechanism according to claim 3, wherein said mounting means for said work surface is a parallelogram linkage mechanism, said mounting member is fixed to one link of said linkage mechanism, said housing is pivotally connected to said pin means, and said rod is pivotally connected to another link of said linkage mechanism pivotal relative to said one link.

6. A mechanism accordingly to claim 1, wherein said locking mechanism is frictionally slidably connected to said coupling means.

7. A mechanism having a base; a work surface; mounting means mounting said work surface for vertical movement relative to said base; a counterbalance mechanism for providing a counterbalance force opposing a downward force tending to lower said work surface; locking means for releasably retaining said work surface in a desired vertical position, said locking means including release means for releasing said locking means to permit vertical movement of said work surface; and control means for selectively controlling said release means, said control means having an operator movable between locking and release positions, and coupling means for coupling said operator to said release means for normally effecting operation of said release means upon movement of said operator into said release position, said coupling means comprising support means, slide means slidably supported by said support means, an input cable having a first wire having first and second ends and being slidably movable within a first sheath having first and second ends, an output cable having a second wire having first and second ends and being slidably movable with a second sheath having first and second ends, connector means slidably supported by said support means and having opposite ends connected to said second end of said first wire and said first end of said second wire, said first wire having said first end thereof connected to said operator for movement thereby, and said second wire having said second end thereof connected to said release means, said first sheath having said first end thereof fixed against movement relative to said operator and said second end thereof connected to said slide means, said second sheath having said first and second ends thereof fixed against movement relative to said support means and locking means, said operator upon movement into said release position tending to move said first and second wires and said connector means in a first direction to effect operation of said release means, and spring means opposing movement of said wires and connector means in said first direction, further spring means opposing movement of said slide means in a direction opposite to said first direction, and said locking means is frictionally slidably connected to said connector means for preventing movement of said connector means when said counterbalance force and said downward force are out of balance by some given extent.

8. A mechanism according to claim 7, wherein said locking means includes a rod supported for movement lengthwise of a housing and said release means is operable to permit said movement of said rod relative to said housing, said mounting means is a parallelogram linkage, said support means includes one link of said linkage, said rod is pivotally connected to said one link and said housing is pivotally connected to another link of said linkage pivotal relative to said one link.

9. A mechanism having a base; a work surface; means for mounting the work surface for vertical movement relative to said base; a counterbalance mechanism for substantially counterbalancing a given load including the weight of said work surface; a lock mechanism for releasably retaining said work surface in desired vertical positions, said lock mechanism having a release means for releasing said lock mechanism to permit vertical movement of said work surface; and control means for selectively controlling said release means, said control means having an operator movable between locking and release positions, coupling means forming a continuous connection extending between said operator and said release means for normally effecting operation of said release means to release said locking mechanism upon movement of said operator into said release position, and means for preventing operation of said release means upon application of a load to said work surface differing by some given extent from said given load, the last said means including a frictional coupling of said lock mechanism to said continuous connection intermediate said operator and said release means.

10. A mechanism according to claim 9, wherein said coupling means includes input and output wires having adjacent ends interconnected by a pin slidably supported by said means for mounting said work surface and opposite ends connected respectively to said operator and said release means, and said last means includes a slidable friction connection between said locking mechanism and said pin.

* * * * *

UNITED STATES PATENT AND TRADEMARK OFFICE

CERTIFICATE OF CORRECTION

PATENT NO. : 6,038,986
DATED : March 21, 2000
INVENTOR(S) : Matthew J. Ransil and Donald R. Pangborn It is certified that error appears in the above-identified patent and that said Letters Patent is hereby corrected as shown below:

Column 1,
Line 16, delete "20"

Column 7,
Line 5, insert -- for -- after "means"

Signed and Sealed this

Nineteenth Day of August, 2003

JAMES E. ROGAN
*Director of the United States Patent and Trademark Office*